United States Patent [19]

Lösel

[11] 4,232,635

[45] Nov. 11, 1980

[54] METHOD OF IMPROVING THE PERMISSIBLE LOAD-VARYING SPEED OF A ONCE-THROUGH STEAM GENERATOR AND DEVICE FOR PERFORMING THE METHOD

[75] Inventor: Georg Lösel, Uttenreuth, Fed. Rep. of Germany

[73] Assignee: Kraftwerk Union Aktiengesellschaft, Mülheim, Fed. Rep. of Germany

[21] Appl. No.: 970,564

[22] Filed: Dec. 18, 1978

[30] Foreign Application Priority Data

Dec. 27, 1977 [DE] Fed. Rep. of Germany ..... 2758278

[51] Int. Cl.[3] ..... F22D 7/00

[52] U.S. Cl. ..... 122/406 ST; 122/451 S; 122/479 S

[58] Field of Search ..... 122/406 S, 406 ST, 448 S, 122/451 S, 479 S

[56] References Cited

U.S. PATENT DOCUMENTS

| | | | |
|---|---|---|---|
| 3,370,573 | 2/1968 | Hanzalek et al. | 122/406 ST |
| 3,411,300 | 11/1968 | Schuetzenduebel et al. | 122/406 S X |
| 3,789,806 | 2/1974 | Gorzegmo | 122/406 ST |
| 3,954,087 | 5/1976 | Stevens et al. | 122/406 S |
| 4,068,475 | 1/1978 | Binstock | 122/406 S X |
| 4,099,384 | 7/1978 | Stevens et al. | 122/406 S |

*Primary Examiner*—Edward G. Favors

*Attorney, Agent, or Firm*—Herbert L. Lerner

[57] ABSTRACT

Method of improving the permissible load-varying speed of a once-through steam generator having a water separating vessel connected between a heating surface of the once-through steam generator and a heating surface of a superheater with a valve connected into a steam delivery line extending from the water separating device to the superheater heating surface, the valve being openable during start-up and shut-down of the once-through steam generator, which includes closing the valve to such a limited extent, depending upon the temperature of the water separating vessel, that the temperature of the water separating vessel corresponds to boiling temperature of feedwater supplied to the once-through steam generator at a pressure at which a transition occurs with respect to pure once-through operation, and device for performing the foregoing method.

3 Claims, 1 Drawing Figure

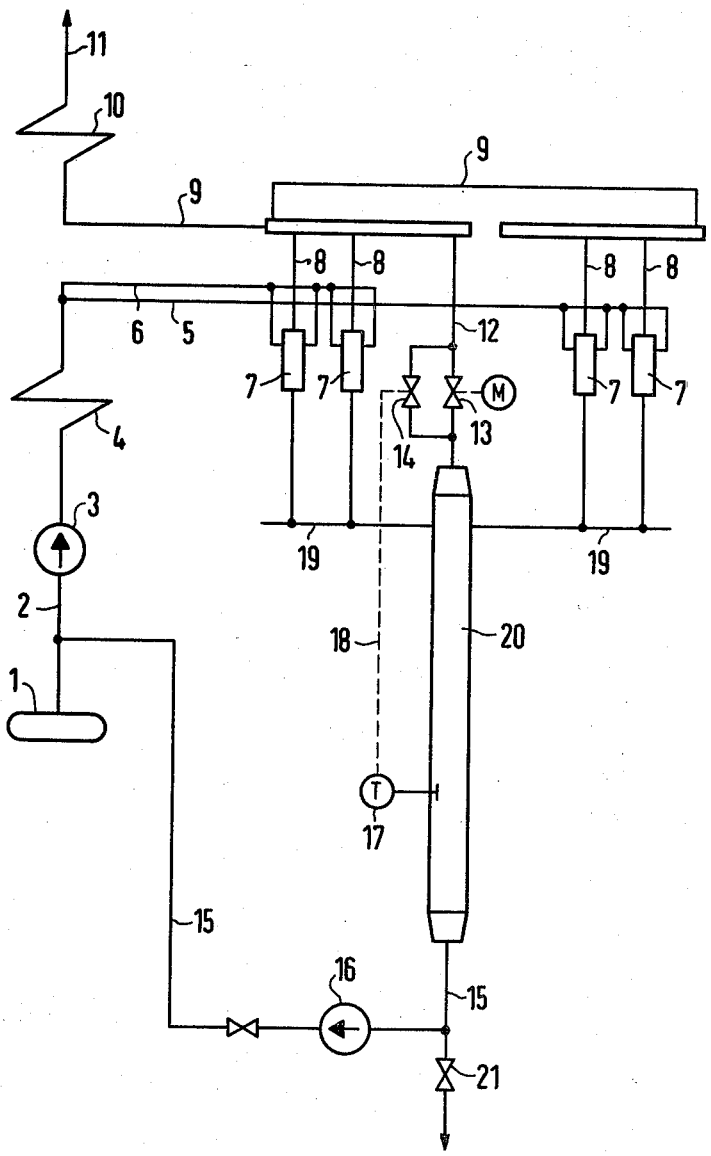
11
10
9
9
8
8
8
8
6
5
12
7
7
7
7
M
13
14
4
3
19
19
2
18
20
1
T
17
15
16
15
21

METHOD OF IMPROVING THE PERMISSIBLE LOAD-VARYING SPEED OF A ONCE-THROUGH STEAM GENERATOR AND DEVICE FOR PERFORMING THE METHOD

The invention relates to a method of improving the permissible load-varying speed of a once-through steam generator and a device for performing the method wherein a water separating vessel is connected between a heating surface of the once-through steam generator and a heating surface of a superheater, with a valve connected into a steam delivery line of the water separating vessel, the valve being openable during start-up and shut-down and, if necessary, also during low or light-load operation.

A steam generator with water separating vessel has been described and displayed heretofore, for example, in "Mitteilugen der Dürrwerke" (Reports of Dürrwerke) No. 1 of September 1956, on pages 6 to 8 and, especially, FIG. 8 thereof. In this prior publication, water separating vessel is connected between two heating surfaces of a Benson steam generator. This water separating vessel is utilized at start-up and shutdown of the once-through boiler and also during low-load operation. During pure once-through operation, the valve connected in the exhaust-steam line of the water separating vessel is closed.

If the boiler should be shutdown, in this heretofore known device, or operate further at low-load, the relatively thick-walled water separating vessel must first be brought back slowly again to operating temperature. For this period, the once-through steam generator cannot go below a given minimal output value. However, even if the value in the exhaust-steam line of the water separating vessel is permitted to be opened, a transition from once-through operation to partial recirculating operation is not readily possible, because a once-through boiler is used in the operation with variable pressure (slide pressure) and the water separating vessel is able to follow only slowly the temperature variations in the heating surfaces. During this manner of operation, the load-varying speed of the once-through boiler is thus also limited by the permissible temperature varying speed of the water separating vessel.

It is accordingly an object of the inveniton to provide a method and device for improving the permissible load-varying speed of a once-through steam generator wherein the load-varying speed is made independent of the stresses in the water separating vessel during temperature variations.

It is an additional object of the invention to provide such a method and device wherein the temperature fluctuations for the water separating vessel are minimized so that the durability of the water separating vessel is increased.

With the foregoing and other objects in view, there is provided, in accordance with the invention, a method of improving the permissible load-varying speed of a once-through steam generator having a water separating vessel connected between a heating surface of the once-through steam generator and a heating surface of a superheater with a valve connected into a steam delivering line extending from the water separating device to the superheater heating surface, the valve being openable during start-up and shut-down of the once-through steam generator, which comprises closing the valve to such a limited extent, depending upon the temperature of the water separating vessel, that the temperature of the water separating vessel corresponds to boiling temperature of feedwater supplied to the once-through steam generator at a pressure at which a transition occurs with respect to pure once-through operation.

In accordance with another aspect of the invention, there is provided a device for performing the foregoing method, comprising a heating surface of a superheater, a water separating vessel connected between and to a heating surface of the once-through steam generator and the heating surface of the superheater, valve means connected in a steam delivery line forming the connection between the water separating vessel and the heating surface of the superheater, the valve means being openable during start-up and shutdown of the once-through steam generator, a plurality of water-steam separator vessels having respective inlets at the steam side thereof connected to the heating surface of the once-through steam generator and having respective outlets at the water side thereof, and a manifold to which the respective outlets of the water-steam separator vessels are connected, the manifold being connected to the water separating vessel.

In accordance with a concomitant feature of the invention, there is provided in a device for performing the hereinaforementioned method, a heating surface of a superheater, a water separating vessel connected between and to a heating surface of the once-through steam generator and the heating surface of the superheater, valve means connected in a steam delivery line forming the connection between the water separating vessel and the heating surface of the superheater, the valve means being openable during start-up and shutdown of the once-through steam generator, the valve means comprising a steam slide valve connected in parallel with a control valve in the steam delivery line, and including a temperature regulating device connected to the control valve for regulating the control valve.

Other features which are considered as characteristic for the invention are set forth in the appended claims.

Although the invention is illustrated and described herein as embodied in method of improving the permissible load-varying speed of a once-through steam generator and device for performing the method it is nevertheless not intended to be limited to the details shown, since various modification and sturctural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing which is schematic view of a device for performing the method of improving the permissible load-varying speed of a once-through steam generator in accordance with the invention.

Referring now to the FIGURE of the drawing, there is shown therein a feedwater tank 1 from which water is supplied through a line 2 with a feed pump 3 and non-illustrated preheaters into an evaporator heating surface 4 of a once-through steam generator. The indiviual tubes of the once-through steam generator, of which only tubes 5 and 6 are shown, terminate in water-steam separator vessels 7 having outlet lines 8 at the steam side thereof that are connected to tubes 9 of a superheater heating surface 10. A line 11 extends from the superheater heating surface 10 to a non-illustrated turbine. The water-steam separator vessels 7 have outlets at the water side thereof leading to a manifold or collecting line 19 which terminates in a water separating vessel 20. In the water separating vessel 20, the water settles out and entrained steam accumulates in the upper region thereof. A steam delivery line 12 also extends from the water separating vessel 20 to the tubes 9 of the superheater surface 10. A steam slide valve or gate valve 13 and a flow control valve 14 parallel thereof are connected into the steam delivery line 12. A water line 15, wherein a circulating pump 16 is provided, extends from a lower connection of the water separating vessel 20 either back to the line 2, as shown in the FIGURE of the drawing, or through outlet or discharge valves 21 and non-illustrated steam expanders or flash tanks to a non-illustrated condenser of the aforementioned non-illustrated turbine A temperature regulating device 17 is connected to the water separating vessel 20 and acts upon the control valve 14 through a control line 18. As long as the once-through steam generator is not performing a purely once-through operation, the steam slide or gate valve 13 is opened and the temperature regulating device 17 is inoperative. The temperature of the water separating vessel 20 corresponds to the boiling temperature of the steam at the given pressure. The instant the once-through steam generator is set into purely once-through operation, the steam slide or gate valve 13 is closed and the pressure in the line or feeder system is further increased. Since the water separating vessle 20 is separated from the once-through system during this operating condition, the temperature therein is reduced. A result thereof is that the temperature regulating device 17 opens the control valve 14 somewhat. So much steam consequently flows out of the manifold or collecting line 19 into the water separating vessel 20 that the temperature thereof assumes a value which was attained during transition into once-through operation.

In the case wherein the output of the boiler is reduced to such an extent that the water separating vessel 20 must be set into operation again, the once-through steam generator is shut down to the corresponding slide or variable pressure value. The water-steam separator vessels 7 can readily follow the temperature variation resulting from this operation because each of these separator vessels 7 has only a small diameter and, therewith, a slight wall thickness. If water should again accumulate in the water-steam separator vessels 7 for the corresponding slide or variable pressure boiling temperature is again attained at this pressure and the water which flows through the manifold or collecting lines 19 into the water separating vessel 20 has the temperature at which the water separating vessel 20 was maintained during once-through operation. Temperature variations of the water separating vessel 20 are thereby largely precluded during operation of the device, so that the permissible load-varying velocity is independent of the permissible temperature variation for the water separating vessel 20.

There are claimed:

1. Method of improving the permissible load-varying speed of a once-through steam generator having a water separating vessel connected between a heating surface of the once-through steam generator and a heating surface of a superheater with a valve connected into a steam delivery line extending from the water separating device to the superheater heating surface, the valve being openable during start-up and shut-down of the once-through steam generator, which comprises closing the valve to such a limited extent, depending upon the temperature of the water separating vessel, that the temperature of the water separating vessel corresponds to boiling temperature of feedwater supplied to the once-through steam generator at a pressure at which a transition occurs with respect to pure once-through operation.

2. Device for performing a method of improving the permissble load-varying speed of a once-through steam generator comprising a heating surface of a superheater, a water separating vessel connected between and to a heating surface of the once-through steam generator and said heating surface of said superheater, valve means connected in a steam delivery line forming the connection betweem said water separating vessel and said heating surface of said superheater, said valve means being openable during start-up and shut-down of the once-through steam generator, a plurality of water-steam separator vessels having respective inlets at the steam side thereof connnected to the heating surface of the once-through steam generator and having respective outlets at the water side thereof and a manifold to which the respective outlets of said water-steam separator vessels are connected, said manifold being connected to the water separating vessel.

3. In a device for performing a method of improving the permissible load-varying speed of a once-through steam generator a heating surface of a superheater, a water separating vessel connected between and to a heating surface of the once-through steam generator and said heating surface of said superheater valve means connected in a steam delivery line forming the connection between said water separating vessel and said heating surface of said superheater, said valve means being openable during start-up and shut-down of the once-through steam generator, said valve means comprising a steam side valve connected in parallel with a control valve in said steam delivery line, and including a temperature regulating device connected to said control valve for regulating said control valve.

* * * * *